US006764074B2

(12) United States Patent
Bangerter

(10) Patent No.: US 6,764,074 B2
(45) Date of Patent: Jul. 20, 2004

(54) COMPACT HOCKEY ARENA

(75) Inventor: Kim Bangerter, Tucumcari, NM (US)

(73) Assignee: K-Bang, LLC, Bountiful, UT (US)

( * ) Notice: Subject to any disclaimer, the term of this patent is extended or adjusted under 35 U.S.C. 154(b) by 0 days.

(21) Appl. No.: 10/327,470

(22) Filed: Dec. 20, 2002

(65) Prior Publication Data

US 2003/0116912 A1 Jun. 26, 2003

Related U.S. Application Data

(60) Provisional application No. 60/343,869, filed on Dec. 21, 2001.

(51) Int. Cl.[7] ..... A63F 7/06; A63B 67/00; A63B 67/04

(52) U.S. Cl. ..... 273/108.1; 273/108.5; 273/126 R; 473/471

(58) Field of Search ..... 273/108.1, 108.5, 273/126 R, 129 K, 129 L, 108.21, 126 A, 127 R, 317.1, 119 R, 285, 287, 118 R, 108.3, 108.31, 108.32, 108.33; 473/471, 162, 157, 158, 159, 173; D21/338, 339, 340, 341

(56) References Cited

U.S. PATENT DOCUMENTS

| | | | | | |
|---|---|---|---|---|---|
| 735,995 | A | * | 8/1903 | Mumford | 273/118 R |
| 1,144,112 | A | * | 6/1915 | Denny | 273/108.57 |
| 1,593,421 | A | * | 7/1926 | Blum | 273/108.5 |
| 1,624,469 | A | * | 4/1927 | Brown | 273/108.5 |
| 3,734,504 | A | * | 5/1973 | Breslow | 273/126 R |
| 3,868,111 | A | * | 2/1975 | Schuelke | 273/108.21 |
| 4,018,443 | A | * | 4/1977 | Bird | 473/471 |
| 4,482,153 | A | * | 11/1984 | Gibbs | 273/108.1 |
| 4,560,163 | A | * | 12/1985 | Erickson | 273/108.1 |
| 5,417,421 | A | * | 5/1995 | Bagley | 273/108.5 |
| 5,785,615 | A | * | 7/1998 | Kosmalski | 473/471 |
| 5,882,007 | A | * | 3/1999 | Gay | 273/108.1 |
| 6,457,711 | B1 | * | 10/2002 | Baulesh | 273/108.1 |

OTHER PUBLICATIONS http://www.box–hockey.com/, Mar. 12, 2003.

* cited by examiner

*Primary Examiner*—Sebastiano Passaniti
(74) *Attorney, Agent, or Firm*—David B. Tingey; Kirton & McConkie

(57) ABSTRACT

Systems and methods for providing a recreational game that promotes coordination, provides a form of exercise, and is an enjoyable pastime. A game box includes a floor, side walls and end walls, wherein each end wall includes a goal formed therein. A center wall extends up from the center of the floor to divide the game box into a plurality of playing areas, and includes one or more passages formed therein to allow a puck to pass from one side of the center wall to the other. Each player utilizes a hockey stick to manipulate a hockey puck. The game is started with a face-off procedure between the players, and once the puck is in play the object is to send the puck through the opponent's goal, which may first require sending the puck through a hole in the center divider. After a goal is made, the face-off procedure is repeated and play resumes until one of the players reaches a predetermined number of goals.

20 Claims, 6 Drawing Sheets

COMPACT HOCKEY ARENA

RELATED APPLICATIONS

This application claims priority to U.S. Provisional Patent Application Serial No. 60/343,869 filed Dec. 21, 2001, entitled COMPACT HOCKEY ARENA.

BACKGROUND OF THE INVENTION

1. Field of the Invention

The present invention relates to recreational games. More particularly, the present invention relates to systems and methods for providing a recreational game that promotes coordination, provides a form of exercise, and is an enjoyable pastime.

2. Background and Related Art

Individuals play recreational games to provide enjoyment and diversion. However, the games that are currently available are typically limited in the amount of coordination they promote and exercise they provide for players of the game.

One type of recreational game is a board game, which typically includes a playing surface and a variety of accessory parts that are used by players of the game. Examples of such accessory parts include cards, a die, playing pieces, and other game pieces. The playing of the board game is dictated by a set of rules or instructions that refer to the movement of selected playing pieces around the playing surface. The cards may include instructions or questions for use while playing the game. The players of the game typically sit or lay around the playing surface while playing the game.

Some board games have been made available as electronic games for one or more players. The players are typically in a sedentary position (e.g., sitting) while playing the game. While the available board games, including electronic board games, have proven to provide entertainment, enjoyment and diversion, they are examples of recreational games that are limited in the amount of coordination they promote and exercise they provide for the players of the game.

Another type of recreational game is a card game, which typically includes a stack of cards that are used to determine the winner of the game. The cards may be passed, played or otherwise used during the game. Similar to board games, card games are typically played by players sitting up to a table, on the floor, or in other sedentary positions.

Thus, while recreational games currently exist, there is a need for recreational games that help the players develop coordination and other motor skills while also providing exercise and enjoyment. Accordingly, it would be an improvement in the art to augment or even replace current recreational game techniques with other techniques.

SUMMARY OF THE INVENTION

The present invention relates to recreational games. More particularly, the present invention relates to systems and methods for providing a recreational game that promotes coordination, provides a form of exercise, and is an enjoyable pastime.

Implementation of the present invention takes place in association with a game box that includes a floor, side walls and end walls as part of a recreational game that promotes coordination, provides a form of exercise, and is an enjoyable pastime for players of the game. In at least one implementation, each end wall includes a goal formed therein. A center wall extends up from the center of the floor to divide the game box into a plurality of playing areas. The center wall includes one or more passages formed therein to allow a puck or ball to pass from one side of the center wall to the other.

The game is played with a plurality of players, each player utilizing a hockey stick to manipulate a hockey puck. The object of the game is to score more goals than the opponent by sending the puck through the opponent's goal formed in the end wall. To start the game, the puck is placed on top of the center wall, and each player stands on opposite sides of the center wall. The players bang their sticks on the side of the box and touch sticks directly above the puck on the center wall and they count each time the sticks touch. On reaching three, the players knock the puck off the center wall and send the puck into the goal of their opponent. Once this "face-off" procedure has started the game, each player attempts to get the puck through the opponent's goal, which may include first having to send the puck through a hole in the center divider. After a goal is made, the face-off procedure is repeated and play is resumed. The game is played until one of the players reaches a predetermined number of points.

While the methods and processes of the present invention have proven to be particularly useful in the area of providing the recreational hockey game provided above, those skilled in the art will appreciate that the game box can be used in association with a large number of rule variations to provide a recreational game that promotes coordination, provides a form of exercise, and is an enjoyable pastime.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to recreational games. More particularly, the present invention relates to systems and methods for providing a recreational game that promotes coordination, provides a form of exercise, and is an enjoyable pastime.

Embodiments of the present invention embrace a game box that includes a floor, a plurality of side walls and plurality of end walls as part of a recreational game that promotes coordination, provides a form of exercise, and is an enjoyable pastime for players of the game. In one embodiment, each end wall includes a goal formed therein that allows a puck, ball or other traveling item to pass therethrough. A center wall extends up from the floor to divide the game box into a plurality of playing areas, and includes one or more passages formed in the center wall to allow the puck to pass therethrough. Each player of the game utilizes a hockey stick to manipulate the puck. The object of the game is to score more goals than the opponent by sending the puck through the opponent's goal formed in the end wall.

In one embodiment, placing the puck on top of the center wall begins the game. Each player stands on opposite sides of the center wall and a face-off procedure occurs. For example, the face-off procedure includes each player simultaneously touching their hockey stick first on a side wall of the box and then with the opponent's sticks directly above the puck on the center wall. The touching of the sticks is performed a predetermined amount of times (e.g., three times), and upon the final time (e.g., third time) that the hockey sticks touch, the players attempt to knock the puck off the center wall and manipulate the puck into the opponent's goal, which may include having to manipulate the puck first through a hole or aperture in the center divider. After a goal is made, the face-off procedure is repeated and play is resumed. This process continues until one of the players reaches a predetermined number of goals.

Those skilled in the art will appreciate that the components of embodiments of the present invention, as generally described and illustrated herein, can be arranged and designed in a wide variety of different configurations. Thus, the following more detailed description of some embodiments of the present invention is not intended to limit the scope of the invention, but is merely representative of embodiments of the invention. Moreover, the illustrated embodiments of the present invention will be best understood by references to the drawings, wherein like parts are designated by like numerals.

Figure 1:
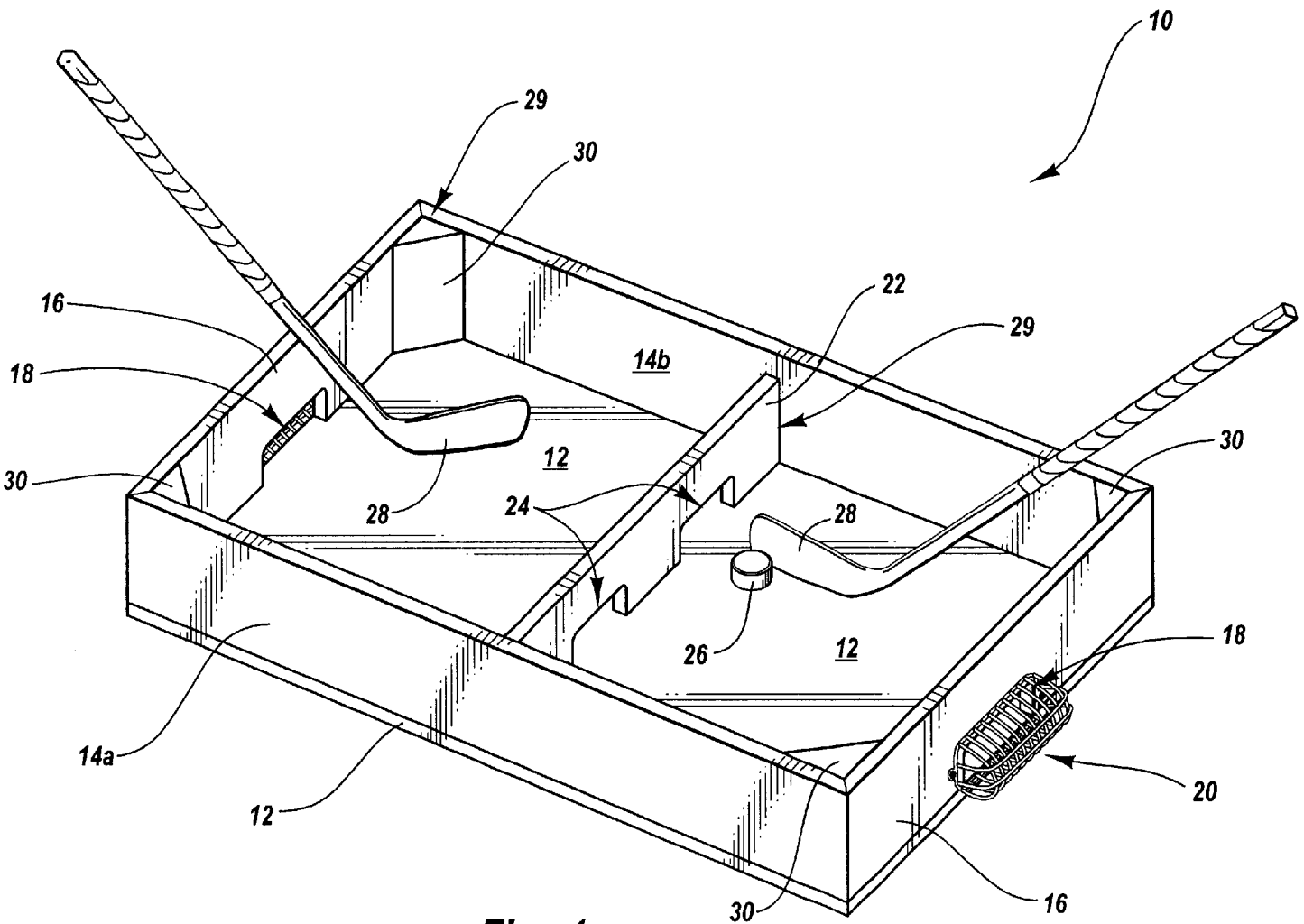
FIG. 1 illustrates a perspective view of a representative embodiment of the present invention.

With reference now to FIG. 1, a perspective view of a representative embodiment of the present invention is illustrated. In FIG. 1, the illustrated embodiment include game box 10, having a floor 12, side walls 14 and end walls 16. In the illustrated embodiment, floor 12 is in the shape of a rectangle, however embodiments of the present invention also embrace other floor configurations, including a floor in the shape of a circle, a square, an oval, an ellipse, or any other suitable shape that provides adequate playing surface. Floor 12 includes a wood, a metal, a composite, a polymer, any combination thereof, or any other material that allows a ball or puck 26, which comprises a rubber, a polymer, or another material, to slide thereon. The material of floor 12 is selected to provide a desired strength and durability to resist abuse inflicted by puck 26 and hockey sticks 28, while allowing a player to selectively slide puck 26 across floor 12 using a hockey stick 28.

In one embodiment the floor 12 comprises a wood, such as plywood, birch and/or another wood. In a further embodiment, floor 12 includes a smooth, finished surface formed thereon to promote the sliding of puck 26 across floor 12.

In another embodiment, the surface of floor 12 includes a plastic, a polymer, a finish, a varnish, a paint, ice or some other material having a tough, relatively smooth surface. In one embodiment, the surface is vinyl. In a further embodiment, floor 12 includes a plurality of holes that allow air to egress up from floor 12 to reduce the friction caused by puck 26 traveling along floor 12.

In FIG. 1, side walls 14 and end walls 16 combine to form a barrier around the edges of floor 12. Furthermore, side walls 14 and side walls 16 are formed to fit the edges of floor 12 for whatever geometry has been selected for the floor. Side walls 14 and end walls 16 include any suitable material such as wood, metal, composite, polymer, or the like that provides a desired strength and durability to resist abuse inflicted by the puck 26 and hockey sticks 28 during use. Similar to floor 12, in at least one embodiment, side walls 14 and/or end walls 16 include a surfacing (e.g., varnish, paint, finish, polymer, etc.) placed thereon to improve the motion of the puck 26 thereagainst or to simply improve aesthetics of game box 10. In one embodiment, the side walls 14 and/or end walls 16 are formed of stock 2×12 lumber cut to proper lengths and then secured together.

In one embodiment, game box is provided such that the components thereof are assembled by a user. For example, in one embodiment, side walls 14 and end walls 16 selectively fit into form-fit slots of floor 12 to assemble game box 10. In another embodiment, side walls 14 and end walls 16 selectively fit into a portion of each other through the use of form-fit slots, and wherein floor 12 selectively fits into form-fit slots in side walls 14 and/or end walls 16. In yet another embodiment, barrel bolts or other securing means, are employed to secure components of the game box together.

In another embodiment, game box 10 comprises a polymer or plastic and is formed from a mold. In other embodiments, as will be further discussed below, game box 10 includes a hinge and/or latch.

Each end wall 16 includes a goal 18 formed therein, which is placed in any desired location of the end wall 16. The placement of the goal 18 may affect the ease with which a goal can be scored by a user or player of game box 10. In one embodiment, goal 18 is placed in the center of each end wall 16, goal 18 notching out an area that would otherwise be in contact with the floor 12. In a further embodiment, a puck stop 20 is provided to stop the puck 26 after it passes through goal 18. Examples of a puck stop include a net, a box, a mechanical stop, or any other device or configuration that stops the travel of puck 26.

In a further embodiment, electronic sensors (not shown) are placed at or about goals 18 to sense when puck 26 passes therethrough. The sensors may be electrically connected to a numeric display, lights, buzzers, or other desired units to alert the players when a goal is scored. The sensors and numeric display may also electronically keep score for the players.

A center wall 22 extends up from floor 12 to divide floor 12 into two portions. In the illustrated embodiment, center wall 22 spans from a first side wall 14*a* to a second side wall 14*b*. In some embodiments, the center wall 22 equally divides the game box 10 into two symmetrical halves. While the illustrated embodiment includes a single center wall, illustrated as center wall 22, those skilled in the art will appreciate that embodiments of the present invention embrace multiple center walls, including multiple center walls used to divide the game box floor into more than two portions.

In the illustrated embodiment of FIG. 1, center wall 22 provides an obstacle to inhibit the travel of puck 26 from one half of the game box 10 to the other. Passages 24 are selectively formed in center wall 22 to strategically allow puck 26 to pass on floor 12 from one side of a center wall to another side. While the illustrated embodiment provides two passages 24, those skilled in the art will appreciate that embodiments of the present invention embrace the use of more than two passages, less than two passages, or the elimination of the center wall. Moreover, embodiments of the present invention embrace a variety of sizes and/or configurations for the passages of center wall 22. In at least some embodiments, center wall 22 is lower than side walls 14 to facilitate keeping puck 26 within game box 10, particularly during a face-off procedure.

Hockey sticks 28 are used by players/users to selectively maneuver, direct, propel, and/or handle puck 26 in the game box 10. In the illustrated embodiment, hockey sticks 26 are standard hockey sticks. Moreover, hockey sticks comprise wood, a polymer or plastic, or any other material that withstands the use thereof.

In at least some embodiments where floor 12 includes corners 29 (e.g. when floor 12 is rectangular), corner stops or wedges 30 are provided to prevent puck 26 from being stuck or otherwise trapped in one of the corners 26 during play. In some embodiments, corner stops 30 form a forty-five degree chamfer with the walls 14, 16 and/or 22. In other embodiments, corner stops 30 include a curved surface to provide a smooth transition from side wall 14 to end wall 16 or between side wall 14 and center wall 22. While corner stops are not illustrated at the interface between side walls 14 and center wall 22, those skilled in the art will appreciate that embodiments of the present invention embrace the use of one or more corner stops in the corners formed by side walls 14 and center wall 22.

Figure 2:
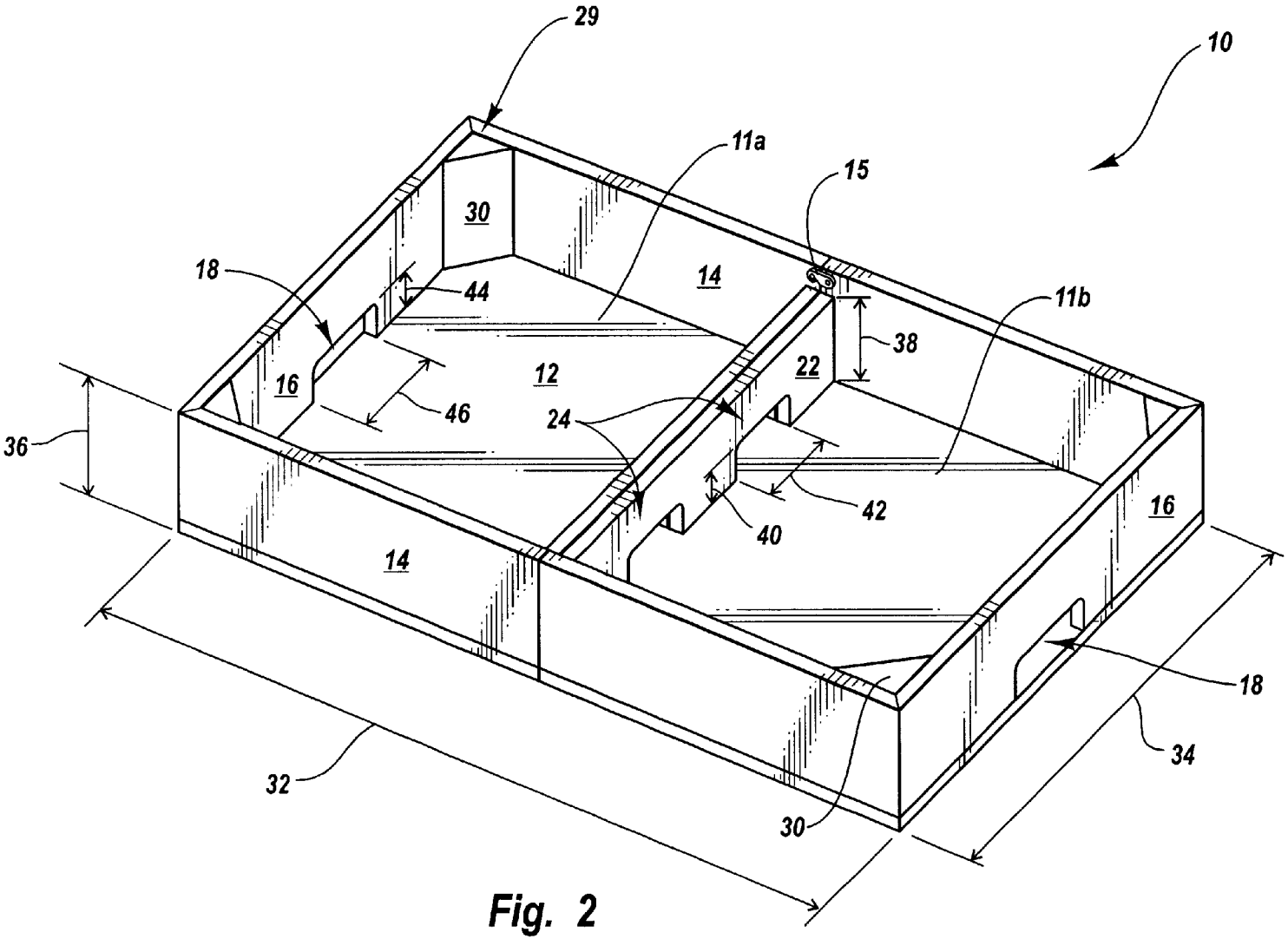
FIG. 2 illustrates a perspective view of an embodiment of the present invention, which includes separatable game box portions.

With reference now to FIG. 2, the dimensions of game box 10 may be selected to accommodate the nature of the game to be played therein. For example, if it is desirable for the players to stand inside game box 10, the dimensions are larger than if the players stand outside and merely place the hockey sticks 28 over floor 12. Similarly, the height of walls 14, 16, 22 may depend on the style of play. The more aggressive the play, the higher the walls 14, 16, 22 may need to be in an effort to prevent the puck 26 from escaping from the game box 10. Moreover, as indicated above, in at least some embodiments, the inside walls (e.g. center walls) are lower than the outside walls (e.g. side walls and/or end walls) to keep the puck from escaping from the game box, especially during a face-off.

In one embodiment, length 32 of game box 10 is about six feet, width 34 is about three feet, and height 36 is about one foot. As provided herein, height 38 of center wall 22 may differ from that of the side walls 14 and end walls 16. A lower height 38 allows the puck to pass over the center wall 22 while still decreasing the likelihood of escape from game box 10. In one embodiment, center wall 22 is about six to eight inches high.

The dimensions of the goals 18 and passages 24 provide a selected difficulty of play. The smaller the goals 18 and passages 24, the more difficult it becomes to score. In certain embodiments, the passage heights 40 may be about two inches and the passage widths 42 may be about four inches. In selected embodiments, the goal heights 44 may be about two inches and the goal widths 46 may be about four inches. Those skilled in the art will appreciate that embodiments of the present invention embrace dimentions that are smaller or that are larger.

Figure 3:
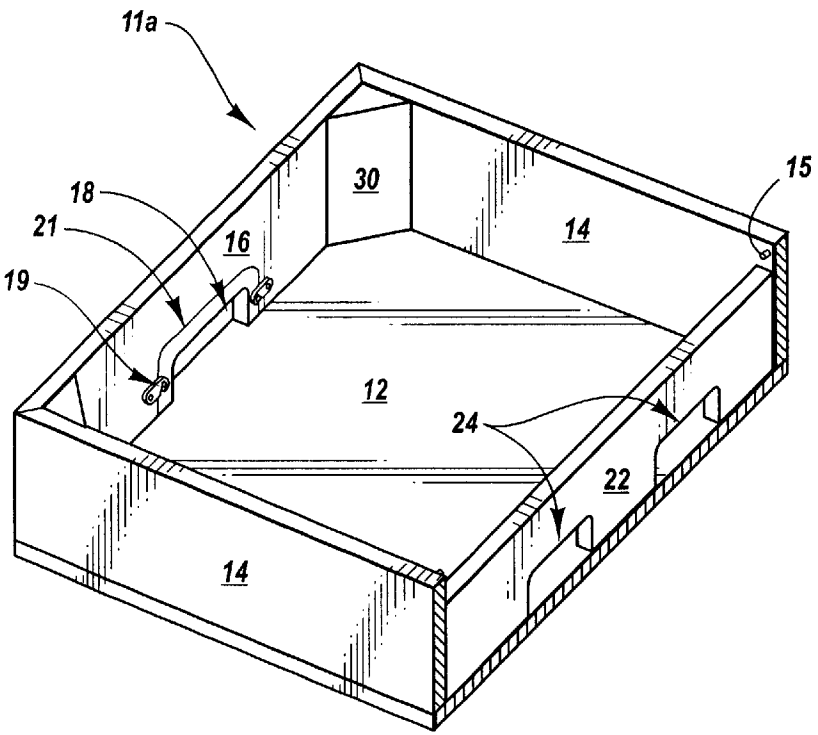
FIG. 3 illustrates a perspective view of a first game box portion in accordance with the embodiment of FIG. 2.

With reference to FIG. 3, an adaptor potion 21 is selectively provided about goal 18 and coupled to end wall 16 by a latch 19 or other fastener to allow the dimensions of the goal to be smaller to make it more difficult to score a goal, such as for advanced players. The extraction of adaptor portion 21 increases the dimensions of the goal and thus facilitates the ease of scoring, such as for use by beginning players. The use of an adaptor portion may optionally be used in association with passages 24 to modify the ease of allowing a puck to pass therethrough.

Figure 4:
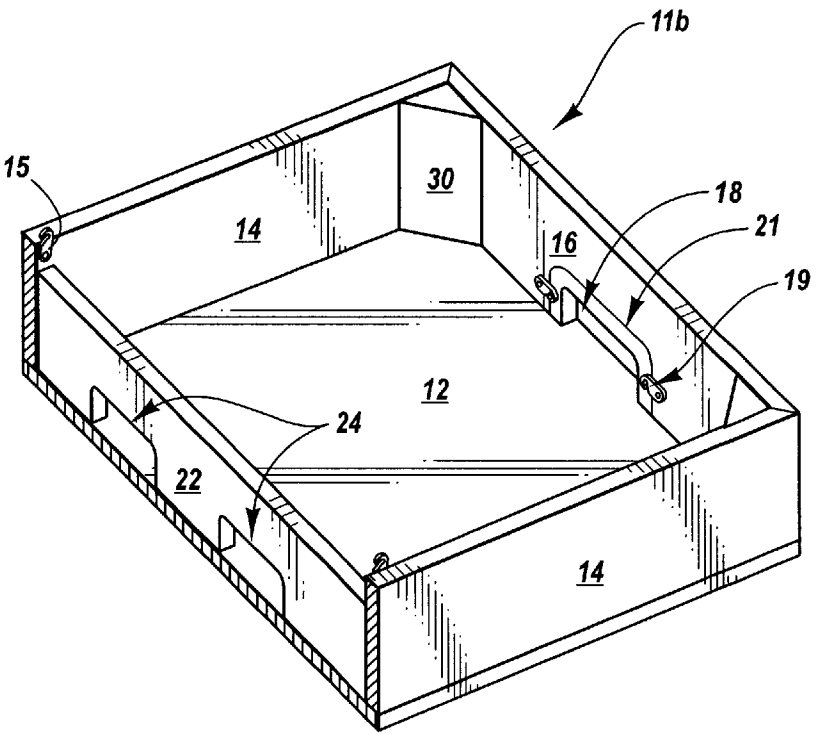
FIG. 4 illustrates a perspective view of a second game box portion in accordance with the embodiment of FIG. 2.

As illustrated in FIGS. 2–4, in one embodiment, game box 10 includes a first game box portion 11*a* and a second game box portion 11*b* that are selectively coupled to form game box 10. In the illustrated embodiment of FIGS. 2–4, a latch 15 is used to retain game box portions 11 coupled together. The portions are then decoupled to allow for the portions 11 to be separated and stored when not in use. As illustrated, each portion 11 includes a center wall 22, however those skilled in the art will appreciate that embodiments of the present invention embrace less than one portion 11 having a center wall 22.

Figure 5:
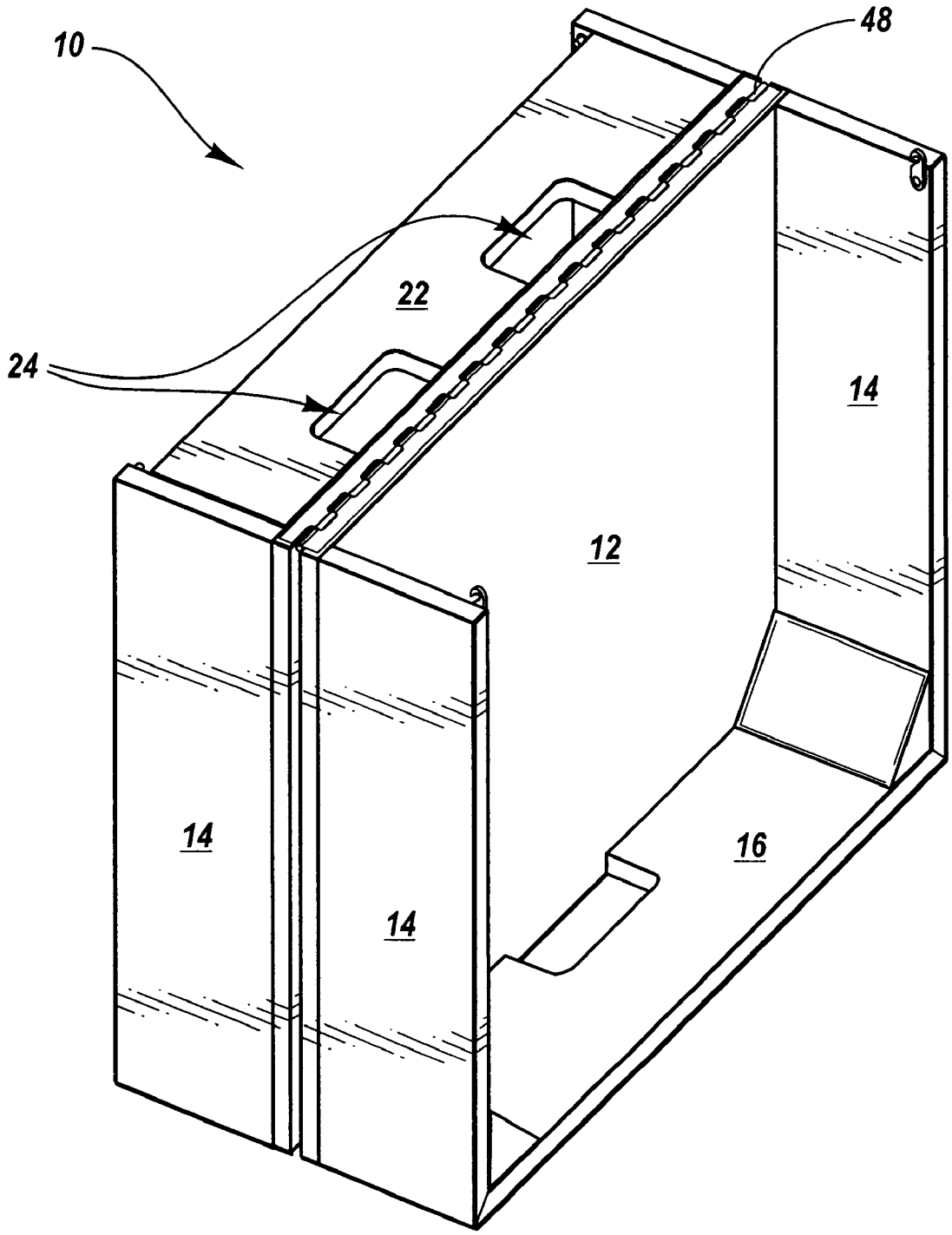
FIG. 5 illustrates a perspective view of a hinged embodiment of the present invention in a collapsed position.
Figure 6:
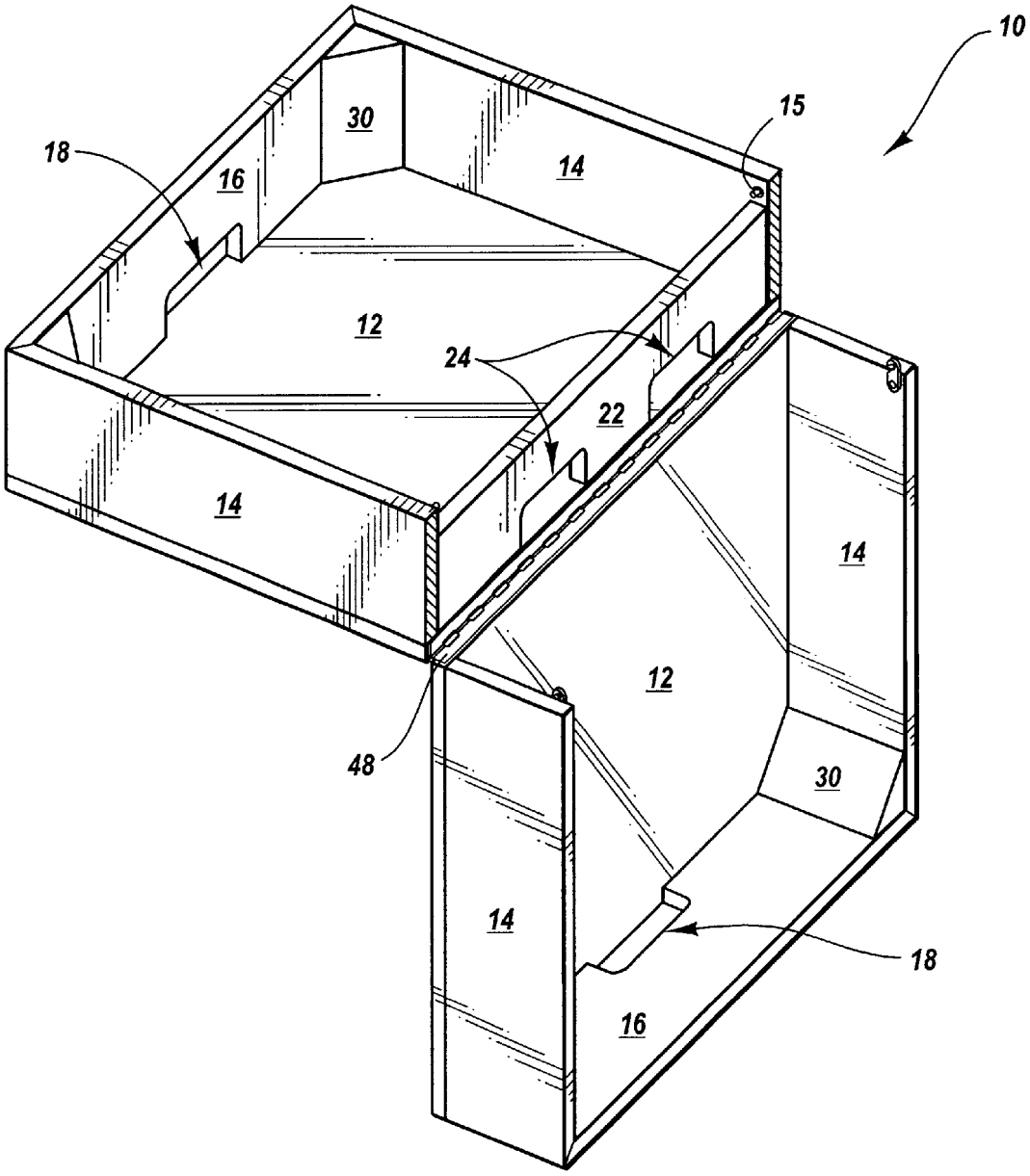
FIG. 6 illustrates assembling the hinged embodiment of FIG. 5.
Figure 7:
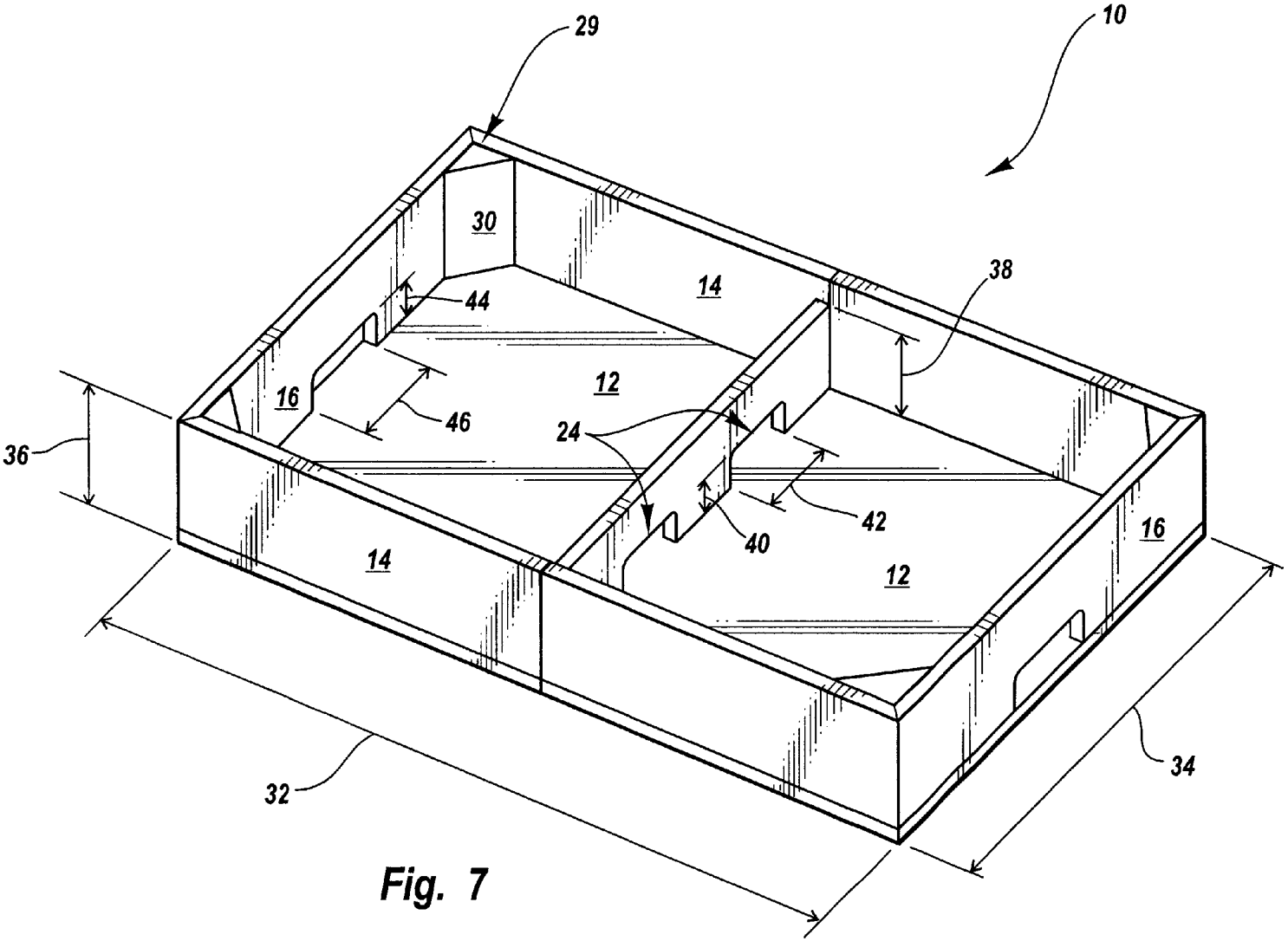
FIG. 7 illustrates an assembled perspective view of the hinged embodiment of FIG. 5.

With reference now to FIGS. 5–7, a hinged embodiment of the present invention is illustrated. In the present embodiment, game box 10 includes hinge 48 running side to side near the center wall 22. Hinge 48 promotes folding of the game box 10 to a storage or non-playing position, as illustrated in FIG. 5 to facilitate storage or transportation. Any suitable hinge may provide the required motion. Other embodiments embrace the use of more than one hinge. In one embodiment, a "piano hinge" is employed. Once, game box 10 is completely folded, as illustrated in FIG. 5, passages 24 provide a handle to facilitate lifting and maneuvering game box 10.

In another embodiment, the hinge couples a first interior wall of a first box portion with a second interior wall of a second box portion. Accordingly, the hinge allows the game box to fold to a storage position, wherein the floor, exterior walls and interior walls form a generally closed box to store the pieces of the game (e.g., puck, hockey sticks, etc.) therein and a goal and/or passage is used as a handle.

Thus, as discussed herein, the embodiments of the present invention embrace recreational games. More particularly, the present invention relates to systems and methods for providing a recreational game that promotes coordination, provides a form of exercise, and is an enjoyable pastime. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A recreational game box comprising:

a floor having a surface that is configured to allow a traveling device to selectively travel on the surface;

one or more exterior walls coupled to the floor, wherein at least one exterior wall includes an aperture therein for use as a goal; and one or more interior walls coupled to the floor, wherein the interior walls include one or more passages to allow the traveling device to travel therethrough, and wherein a height of at least one of the interior walls is lower than a height of the exterior walls.

2. A recreational game box as recited in claim 1, wherein the traveling device is one of:

(i) a puck; and (ii) a ball.

3. A recreational game box as recited in claim 1, wherein the floor comprises at least one of:

(i) a wood;

(ii) a polymer;

(iii) a composite; and (iv) a metal.

4. A recreational game box as recited in claim 1, wherein the surface reduces the friction between the floor and the traveling device.

5. A recreational game box as recited in claim 1, wherein the one or more exterior walls and the one or more interior walls are coupled to the floor by at least one of:

(i) a fastener;

(ii) a form-fit slot; and (iii) an adhesive.

6. A recreational game box as recited in claim 1, further comprising a corner stop coupled to at least one of:

(i) one of the exterior walls; and (ii) one of the interior walls.

7. A recreational game box as recited in claim 1, further comprising an adapter selectively coupled to the at least one exterior wall to modify a dimension of the aperture.

8. A recreational game box comprising:

a first box portion having a first floor and a plurality of walls coupled to the first floor, wherein one of the walls is an exterior wall when in a playing position and includes an aperture therein for use as a first goal, wherein another of the walls is an interior wall when in the playing position, and wherein a height of the interior wall is lower than a height of the exterior wall;

a second box portion having a second floor and one or more walls coupled to the second floor, wherein at least one wall of the second box portion includes an aperture therein for use as a second goal; and a coupling mechanism, wherein a first portion of the coupling mechanism is coupled to the first box portion and a second portion of the coupling mechanism is coupled to the second box portion, and wherein the coupling mechanism enables the first portion and the second portion to be in one of:

(i) the playing position; and (ii) a non-playing position.

9. A recreational game box as recited in claim 8, wherein the coupling mechanism includes at least one of:

(i) a hinge; and (ii) a latch.

10. A recreational game box as recited in claim 9, wherein the interior wall includes one or more apertures for use as one or more corresponding passages.

11. A recreational game box as recited in claim 10, wherein at least one of the one or more walls of the second portion is an interior wall when in the playing position and includes one or more apertures for use as one or more corresponding passages.

12. A recreational game box as recited in claim 11, wherein the one or more apertures of the interior wall of the first portion correspond to the one or more apertures of the interior wall of the second portion when in the playing position.

13. A recreational game box as recited in claim 10, wherein the interior wall of the first portion provides a handle for use in the non-playing position.

14. A recreational game box as recited in claim 8, further comprising an adapter selectively coupled to the exterior wall of the first box portion to modify a dimension of the aperture.

15. A recreational game box as recited in claim 9, wherein the non-playing position includes a decoupling of the latch to allow the first box portion to be separated from the second box portion.

16. A method for playing a recreational game, the method comprising the steps for:

providing a game box that includes a floor, exterior walls coupled to the floor, and one or more interior walls coupled to the floor, wherein at least one of the exterior walls includes an aperture therein for use as a goal, wherein a height of the one or more interior walls is lower than a height of the exterior walls, and wherein at least one interior wall includes an aperture as a passage;

providing a traveling device for use in selectively traveling across the floor;

providing a hockey stick for each player of the recreational game;

engaging in a face-off procedure; and using the hockey stick to cause the traveling device to travel across the floor and into the goal.

17. A method for playing a recreational game as recited in claim 16, wherein the face-off procedure comprises the steps for:

placing the traveling device on an interior wall of the game box having the lower height than the height of the exterior walls;

allowing each player touching their hockey stick first on a side wall of the game box and then with an opponent's stick for a predetermined number of times; and attempting to knock the traveling device off of the interior wall and within the exterior walls to begin play.

18. A method for playing a recreational game as recited in claim 16, further comprising the step for using the hockey stick to manipulate the traveling device through the passage.

19. A method for playing a recreational game as recited in claim 16, further comprising one of the steps for:

(i) playing the game while being positioned outside of the game box; and (ii) playing the game while being positioned inside of the game box.

20. A method for playing a recreational game as recited in claim 16, further comprising a step for selectively coupling an adapter to the at least one of the exterior walls to modify a dimension of the aperture.

* * * * *